US009157433B2

(12) United States Patent
Wang et al.

(10) Patent No.: US 9,157,433 B2
(45) Date of Patent: Oct. 13, 2015

(54) PRESSURE-CONTROLLING APPLIANCE FOR AN INFLATABLE PRODUCT

(75) Inventors: Cheng-Chung Wang, Taipei (TW); Chien-Hua Wang, Taipei (TW)

(73) Assignee: Team Worldwide Corporation, Taipei (TW)

( * ) Notice: Subject to any disclaimer, the term of this patent is extended or adjusted under 35 U.S.C. 154(b) by 758 days.

(21) Appl. No.: 12/771,090

(22) Filed: Apr. 30, 2010

(65) Prior Publication Data

US 2010/0278659 A1 Nov. 4, 2010

(30) Foreign Application Priority Data

May 2, 2009 (CN) ..... 2009 1 0039200

(51) Int. Cl.
*F04B 49/08* (2006.01)
*A47C 27/08* (2006.01)
*F04B 49/02* (2006.01)

(52) U.S. Cl.
CPC ..... *F04B 49/08* (2013.01); *A47C 27/081* (2013.01); *F04B 49/022* (2013.01)

(58) Field of Classification Search
CPC ..... A47C 27/081; F04B 49/03; F04B 49/08; F04B 49/022
USPC ..... 417/44.2, 234, 315, 442; 5/706, 708, 5/710, 713; 137/223, 228, 233
See application file for complete search history.

(56) References Cited

U.S. PATENT DOCUMENTS

| | | | | |
|---|---|---|---|---|
| 4,424,738 | A * | 1/1984 | Leighton | 91/422 |
| 6,014,784 | A * | 1/2000 | Taylor et al. | 5/713 |
| 6,679,686 | B2 * | 1/2004 | Wang | 417/423.1 |
| 6,990,700 | B2 * | 1/2006 | Chung | 5/713 |
| 7,246,394 | B2 * | 7/2007 | Wang | 5/713 |
| 7,330,127 | B2 * | 2/2008 | Price et al. | 340/666 |
| 7,426,766 | B2 * | 9/2008 | Gammons | 5/713 |
| 7,475,440 | B2 * | 1/2009 | Chaffee | 5/644 |
| 7,647,662 | B2 | 1/2010 | Wang | |
| 7,901,193 | B2 * | 3/2011 | Evans et al. | 417/442 |
| 2002/0073783 | A1 * | 6/2002 | Wilner et al. | 73/716 |
| 2002/0194678 | A1 * | 12/2002 | Chung | 5/713 |
| 2006/0085918 | A1 * | 4/2006 | Metzger | 5/713 |
| 2007/0227594 | A1 * | 10/2007 | Chaffee | 137/224 |
| 2008/0286117 | A1 * | 11/2008 | Kehrmann et al. | 417/1 |
| 2011/0011465 | A1 | 1/2011 | Wang et al. | |
| 2011/0284108 | A1 | 11/2011 | Wang et al. | |

* cited by examiner

*Primary Examiner* — Charles Freay
*Assistant Examiner* — Philip Stimpert

(57) ABSTRACT

A pressure-controlling appliance for an inflatable product has a inflatable body, a pump mounted in the inflatable body, a pump switch and an inflation-deflation valve. The pump inflates or deflates the inflatable bodythrough the inflation-deflation valve. The pressure-controlling appliance also comprises an inflation-deflation controlling mechanism and a pressure-controlling mechanism. The inflation-deflation controlling mechanism is applied to open and close the inflation-deflation valve and to turn the pump switch on or off. The pressure-controlling mechanism operates the inflation-deflation controlling mechanism according to the pressure in the inflatable body that compared with the high or low reference pressure.

27 Claims, 8 Drawing Sheets

PRESSURE-CONTROLLING APPLIANCE FOR AN INFLATABLE PRODUCT

BACKGROUND OF THE INVENTION

1. Field of the Invention

The present invention relates to a pressure-controlling appliance for an inflatable product.

2. Description of the Prior Arts

Inflatable beds are significantly lighter than traditional beds and may be used indoors or outdoors. When deflated, inflatable beds have a smaller volume, and thus are stowed and carried easily. Inflatable beds may used in the house for guests, in the office for taking a nap, outdoors for camping and the like.

Inflating and deflating appliances have been developed for inflatable beds and similar inflatable objects. The conventional inflating appliance comprises a pump, a pump switch and an inflating valve. When inflating, the pump switch is connected and the pump is operated to inflate the inflatable object. When the inflatable object is filled up with air, the pump switch is disconnected to shut down the pump. Then the inflating valve is closed. When deflating, the inflating valve is opened to allow the air to exhaust.

However, the conventional inflating appliance cannot determine the air pressure in the inflatable body. This may negatively impact safety.

SUMMARY OF THE INVENTION

To overcome the shortcomings, the present invention provides a pressure-controlling appliance for an inflatable product, which inflates and deflates automatically and is easily controlled.

To achieve above objective, the present invention provides a pressure-controlling appliance for an inflatable product. In embodiments of the present invention, the pressure-controlling appliance comprises an inflatable body, a pump mounted in the body, a pump switch and an inflation-deflation valve. The pump inflates or deflates the inflatable body through the inflation-deflation valve. The pressure-controlling appliance also comprises an inflation-deflation controlling mechanism and a pressure-controlling mechanism.

The inflation-deflation controlling mechanism is applied to open or close the inflation-deflation valve and to turn the pump switch on or off. The pressure-controlling mechanism operates the inflation-deflation controlling mechanism based on the pressure in the inflatable body compared with a high or low reference pressure.

The pressure-controlling mechanism is a movable assembly that moves based on the pressure in the inflatable body compared with the high or low reference pressure and operates the inflation-deflation controlling mechanism to close the inflation-deflation valve and to turn the pump switch off.

The inflation-deflation controlling mechanism comprises a valve bladder, a valve shaft and a recovering device. One end of the valve shaft is connected to the valve bladder and the other end of the valve shaft is connected to the inflation-deflation valve through the recovering device. The valve shaft has a protrusion selectively contacting the pump switch when an external force acts on the valve bladder.

When an external force acts on the valve bladder, the valve shaft moves downwards and opens the inflation-deflation valve, and the protrusion on the valve shaft forces the pump switch to connect. The pressure-controlling mechanism blocks the valve shaft and keeps the inflation-deflation valve open. When the pressure in the inflatable body is higher than the high reference pressure during inflation or lower than the low reference pressure during deflation, the pressure-controlling mechanism leaves the valve shaft and the valve shaft is returned by the recovering device.

The pressure-controlling mechanism comprises a moving bladder, a moving shaft and a limiting rod. One end of the moving shaft is connected to the moving bladder. A first recess is formed in the other end of the moving shaft and corresponds to a roller on one end of the limiting rod. The limiting rod has a limiting protrusion corresponding to and selectively engaging a second recess in the valve shaft. The other end of the limiting rod is fastened to a fixed axis. The first recess on the moving shaft selectively moves up and down relative to the roller on the limiting rod.

When the pressure in the inflatable body is higher than the high reference pressure during inflation, the moving shaft moves upward. When the pressure in the inflatable body is lower than the low reference pressure during deflation, the moving shaft moves downward. The moving shaft pushes the limiting rod away to disengage the limiting protrusion on the limiting rod with the second recess of the valve shaft.

The moving bladder is mounted in a chamber. The chamber communicates with the inflatable body through an inlet of the moving bladder. An external force acts on the valve bladder via a manual bladder connected to the valve bladder.

In embodiments of the present invention, the inflation-deflation controlling mechanism comprises a positioning panel, a lifting device that may move up and down a certain distance and a first recovering device. The positioning panel is connected to the inflation-deflation valve through the lifting device and the first recovering device.

When an external force acts on the positioning panel, the pump switch is connected and the pressure-controlling mechanism blocks the positioning panel. The lifting device moves downward a certain distance and the inflation-deflation valve is opened. When the pressure in the inflatable body is higher than the high reference pressure during inflation or lower than the low reference pressure during deflation, the pressure-controlling mechanism leaves the positioning panel and the lifting device is returned via the first recovering device.

The pressure-controlling mechanism comprises a moving bladder, a moving shaft, a first linking rod and a second linking rod. One end of the moving shaft is connected to the moving bladder and the other end of the moving shaft is connected to the first linking rod. The first linking rod is pivoted along a fixed axis and is connected to the second linking rod. An end of the second linking rod engages the recess formed in the positioning panel.

When the pressure in the inflatable body is higher than the high reference pressure during inflation or lower than the low reference pressure during deflation, the moving shaft moves up or down. The first linking rod moves the second linking rod to disengage the second linking rod from the positioning panel.

The lifting device comprises a lifting button mounted under the positioning panel, a lifting rod being coaxial with the positioning panel and moving along a lifting curved surface in the lifting button and a linking rod mounted under the lifting button. The linking rod is connected to the inflation-deflation valve through the first recovering device.

The moving bladder is connected to an air opening through a tube.

The second linking rod has multiple linking positioning recesses to selectively engage the protrusion of the first linking rod.

The positioning panel provides external force through a control switch connected to the positioning panel. The positioning panel is a rotating positioning panel or a pressing positioning panel, and the control switch is a knob or a push-button.

In embodiments of the present invention, the pressure-controlling mechanism comprises a moving bladder, a moving shaft, a detecting switch, an electromagnet and a third linking rod. One end of the moving shaft is connected to the moving bladder and the other end contacts with the detecting switch via the operating of the moving bladder. The electromagnet is connected electrically to the detecting switch and one end of the third linking rod. The other end of the third linking rod selectively engages the recess of the positioning panel.

When the pressure in the inflatable body is higher than the high reference pressure during inflation, the moving shaft moves up to contact with the detecting switch. When the pressure in the inflatable body is lower than the low reference pressure during deflation, the moving shaft moves down to contact with the detecting switch. When the detecting switch sends a signal to move the electromagnet up and down, the third linking rod is moved up and down to disengage the third linking rod from the positioning panel.

The electromagnet is a push-pull electromagnet.

In embodiments of the present invention, the inflating-deflating mechanism comprises a control circuit, a driving device, a second lifting device and a third recovering device. The control circuit generates controlling commands to switch on or off the pump switch. The control circuit drives the second lifting device up and down through the driving device. The second lifting device is connected to the inflation-deflation valve through the third recovering device.

When a command is input into the control circuit, the pump switch is connected and the lifting device descends a certain distance. When the pressure in the inflatable body is higher than the high reference pressure during inflation or lower than the low reference pressure during deflation, the pressure-controlling mechanism outputs a signal to the control circuit. The control circuit disconnects the pump switch. The second lifting device is returned and the inflation-deflation valve is closed via the third recovering device.

The lifting device comprises a worm rod connecting to the driving device and a worm gear engaging the worm rod. The worm gear abuts the third recovering device.

The pressure-controlling mechanism comprises a moving bladder, a moving shaft and a second detecting switch. One end of the moving shaft is connected to the moving bladder and the other end selectively contacts the second detecting switch via the operation of the moving bladder.

When the pressure in the inflatable body is higher than the high reference pressure during inflation, the moving shaft moves up to contact with the second detecting switch to send a signal to the control circuit. When the pressure in the inflatable body is lower than the low reference pressure during deflation, the moving shaft moves down to contact with the second detecting switch to send a signal to the control circuit.

In embodiments of the present invention, a pressure-controlling appliance comprises a inflatable body, a pump mounted in the inflatable body, a pump switch and an inflation-deflation valve. The pump inflates or deflates the inflatable bodythrough the inflation-deflation valve. The pressure-controlling appliance also comprises an inflation-deflation controlling mechanism and a pressure-controlling mechanism.

The inflation-deflation controlling mechanism is applied to open or close the inflation-deflation valve and to turn the pump switch on. The pressure-controlling mechanism operates the inflation-deflation controlling mechanism and turns the pump switch off based on the pressure in the inflatable body that compared with the high or low reference pressure.

The present invention has advantages as follow:

The present invention has an inflation-deflation controlling mechanism and a pressure-controlling mechanism to automatically control the inflation-deflation valve and the pump. By referring to the pressure in the inflatable body to determine whether the pump is started, the operation for the user is simplified and safety is maintained when inflating.

DETAILED DESCRIPTION OF THE PREFERRED EMBODIMENTS

Figure 1:
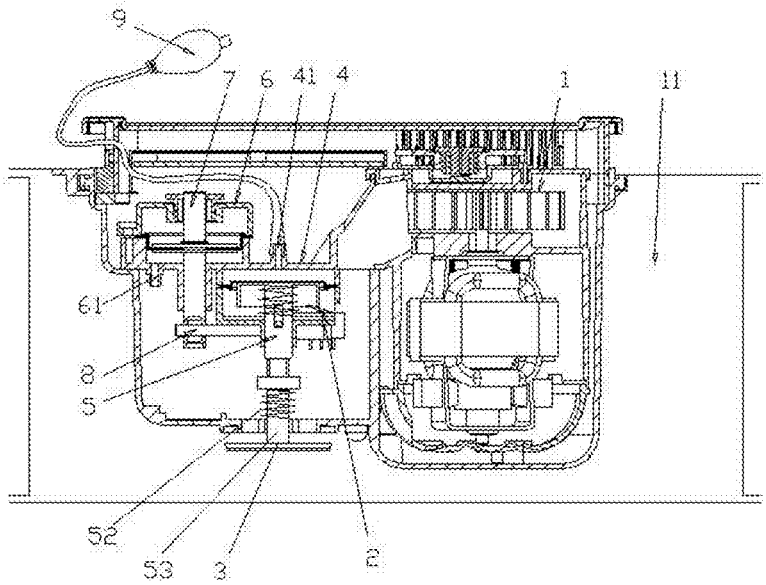
FIG. 1 is a front view in partial section of a first embodiment of a pressure-controlling appliance in accordance with the present invention.
Figure 2:
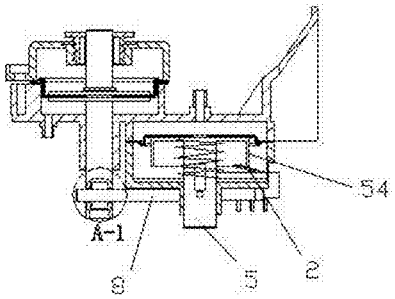
FIG. 2 is an operational partially front view of the pressure-controlling appliance in FIG. 1, showing initial status.
Figure 3:
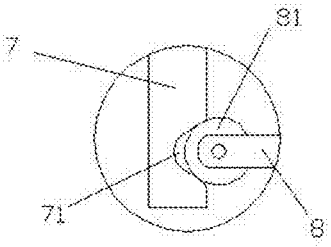
FIG. 3 is an enlarged side view of the pressure-controlling appliance, showing section A-1 in FIG. 2.
Figure 4:
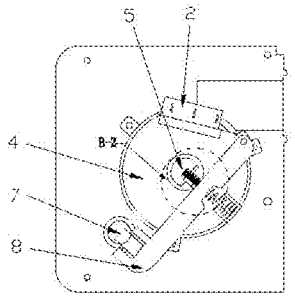
FIG. 4 is a partially bottom view of the pressure-controlling appliance in FIG. 2.
Figure 5:
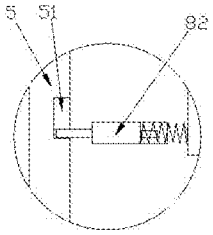
FIG. 5 is an enlarged side view of the pressure-controlling appliance, showing section B-1 in FIG. 4.
Figure 6:
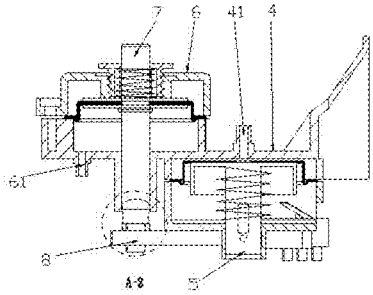
FIG. 6 is an operational partially side view of the pressure-controlling appliance, showing stopping status.
Figure 7:
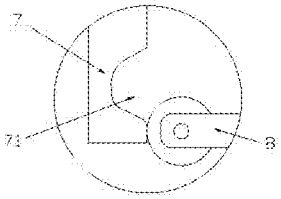
FIG. 7 is an enlarged side view of the pressure-controlling appliance, showing section A-2 in FIG. 6.
Figure 8:
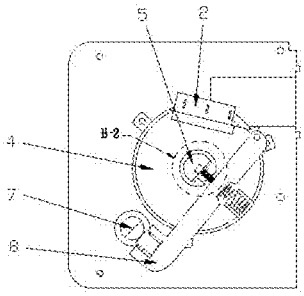
FIG. 8 is a partially bottom view of the pressure-controlling appliance in FIG. 6.
Figure 9:
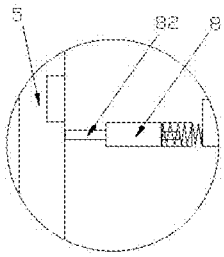
FIG. 9 is an enlarged side view of the pressure-controlling appliance, showing section B-2 in FIG. 8.
Figure 10:
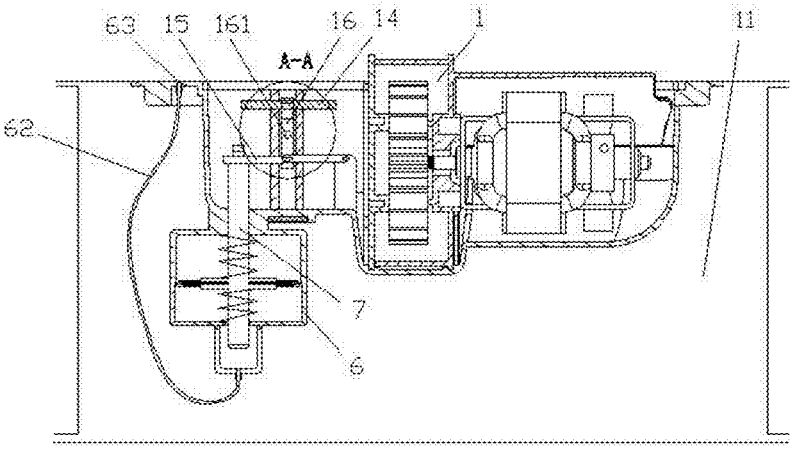
FIG. 10 is a front view in partial section of a second embodiment of a pressure-controlling appliance in accordance with the present invention.
Figure 11:
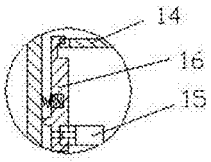
FIG. 11 is an enlarged side view of the pressure-controlling appliance, showing section A-A in FIG. 10.
Figure 12:
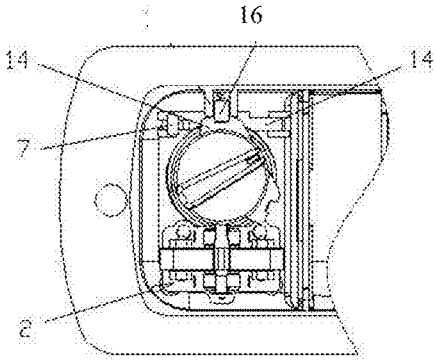
FIG. 12 is partially top view of the pressure-controlling appliance in FIG. 10.
Figure 13:
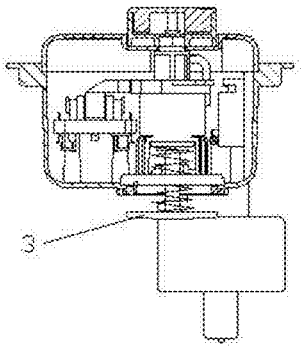
FIG. 13 is a side view of the pressure-controlling appliance in FIG. 12.
Figure 14:
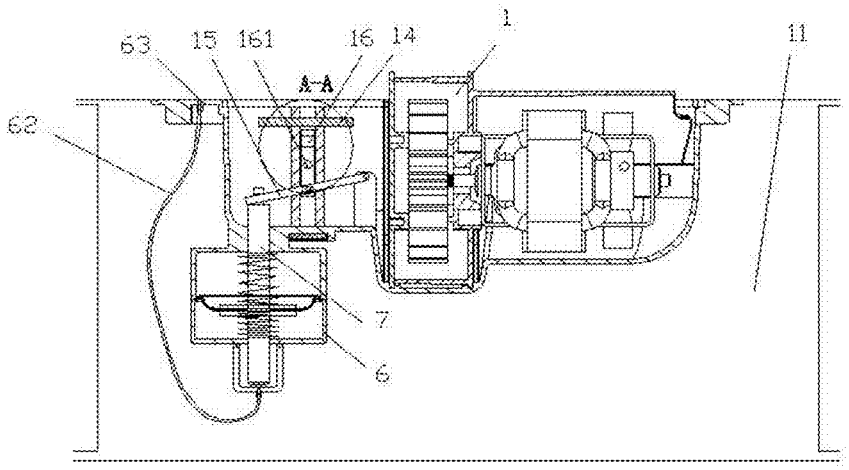
FIG. 14 is an operational front view in partial section of the pressure-controlling appliance in FIG. 10, showing inflating to a predetermined pressure.
Figure 15:
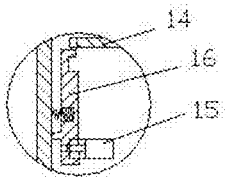
FIG. 15 is a cross-sectional side view of the pressure-controlling appliance, showing section A-A in FIG. 14.
Figure 16:
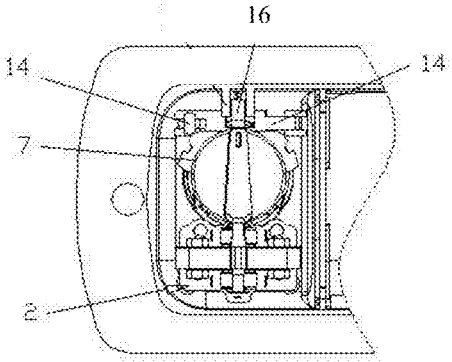
FIG. 16 is a partially top view of the pressure-controlling appliance in FIG. 14.
Figure 17:
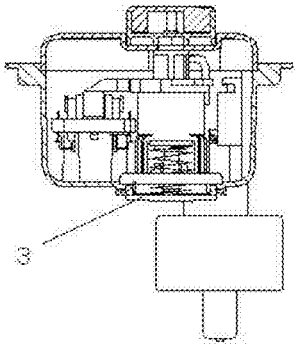
FIG. 17 is a side view of the pressure-controlling appliance in FIG. 16.
Figure 18:
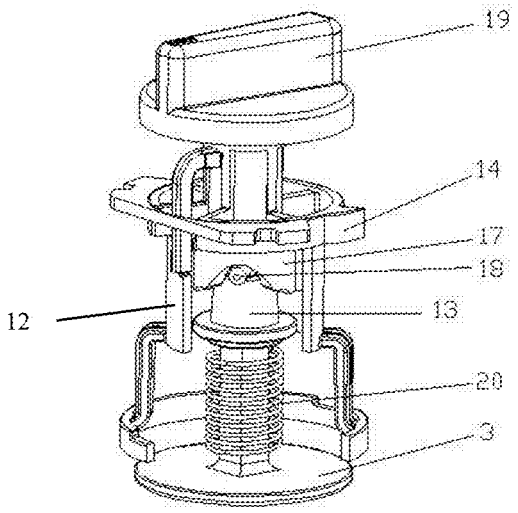
FIG. 18 is an operational perspective view of an inflating-deflating mechanism of the pressure-controlling appliance in FIG. 10, showing closed.
Figure 19:
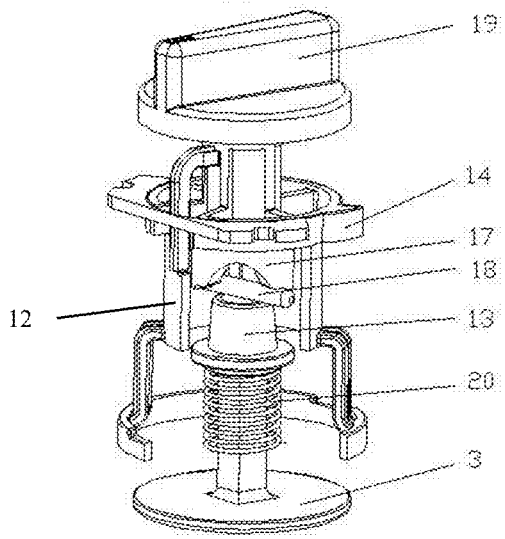
FIG. 19 is an operational perspective view of the inflating-deflating mechanism of the pressure-controlling appliance in FIG. 10, showing opening.
Figure 20:
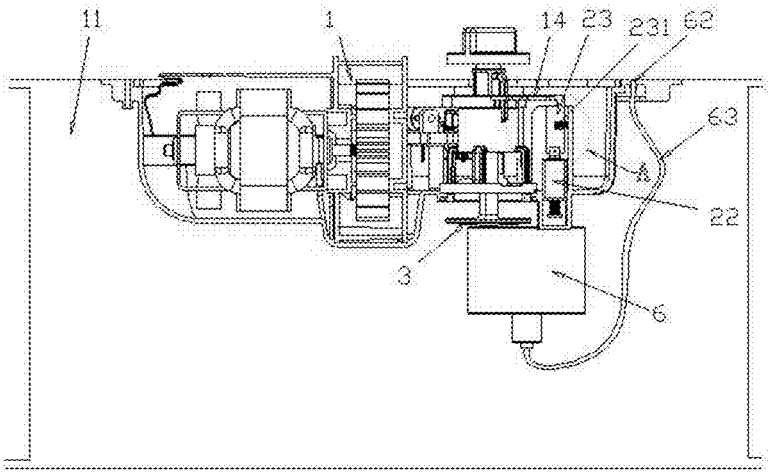
FIG. 20 is a front view of a third embodiment of a pressure-controlling appliance in accordance with the present invention.
Figure 21:
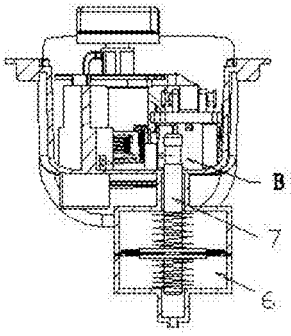
FIG. 21 is a partially side view of the pressure-controlling appliance in FIG. 20.
Figure 22:
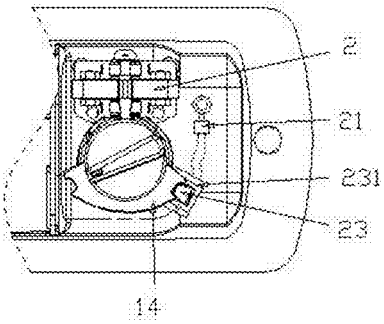
FIG. 22 is a top view of the pressure-controlling appliance in FIG. 21.
Figure 23A:
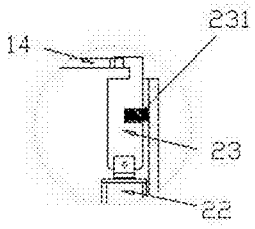
FIG. 23A is an enlarged side view of the pressure-controlling appliance, showing section A in FIG. 21.
Figure 23B:
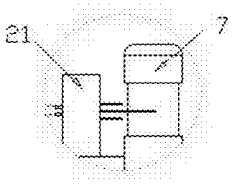
FIG. 23B is an enlarged side view of the pressure-controlling appliance, showing section B in FIG. 22.

The present invention is described below referring to the drawings in greater detail.

Embodiment 1

With reference to FIGS. 1 to 9, a pressure-controlling appliance in accordance with the present invention comprises a inflatable body, a pump (1) mounted in the inflatable body, a pump switch (2) and an inflation-deflation valve (3). The pump (1) inflates or deflates the inflatable body (11) through the inflation-deflation valve (3). The pump switch (2) controls the pump (1). Additionally, the pressure-controlling appliance also comprises an inflation-deflation controlling mechanism and a pressure-controlling mechanism.

The inflation-deflation controlling mechanism is applied to open or close the inflation-deflation valve (3) and to turn the pump switch (2) on or off. The pressure-controlling mechanism operates the inflation-deflation controlling mechanism based on the pressure in the inflatable body (11) compared with a high or low reference pressure.

The pressure-controlling mechanism is a movable assembly that moves based on the pressure in the inflatable body compared with the high or low reference pressure and operates the inflation-deflation controlling mechanism to close the inflation-deflation valve (3) and to turn the pump switch (2) off.

The inflation-deflation controlling mechanism comprises a valve bladder (4), a valve shaft (5) and a recovering device. One end of the valve shaft (5) is connected to the valve bladder (4) and the other end of the valve shaft (5) is connected to the inflation-deflation valve (3) through the recovering device. The recovering device has a spring (52) and a supporting rod (53) mounted through the spring (52). One end of the supporting rod (53) is connected to the valve shaft (5) and the other end of the supporting rod (53) is connected to the inflation-deflation valve (3). The valve shaft (5) has a protrusion (54) selectively contacting with the pump switch (2) when an external force acts on the valve bladder (4).

When an external force acts on the valve bladder (4), the valve bladder (4) drives the valve shaft (5) to move downward and opens the inflation-deflation valve (3), and the protrusion (54) on the valve shaft (5) forces the pump switch (2) to connect. The pressure-controlling mechanism blocks the valve shaft (5) and keeps the inflation-deflation valve (3) open. Then the pump (1) is started and inflates or deflates according to the pre-adjusted operating direction. When the pressure in the inflatable body (11) is higher than the high reference pressure during inflation or lower than the low reference pressure during deflation, the pressure-controlling mechanism leaves the valve shaft (5) and the valve shaft (5) is returned by the recovering device. The pump switch (2) is disconnected and the inflation-deflation valve (3) is closed, thereby stopping inflation or deflation.

The pressure-controlling mechanism comprises a moving bladder (6), a moving shaft (7) and a limiting rod (8). One end of the moving shaft (7) is connected to the moving bladder (6). A first recess (71) is formed in the other end of the moving shaft (7) and corresponds to a roller (81) on one end of the limiting rod (8). The limiting rod (8) has a limiting protrusion (82) corresponding to and selectively engaging a second recess (51) in the valve shaft (5). The other end of the limiting rod (8) is fastened on a fixed axis. The first recess (71) on the moving shaft (7) selectively moves up and down relative to the roller (81) on the limiting rod (8).

When the pressure in the inflatable body (11) is higher than the high reference pressure during inflation, the moving shaft (7) moves upward. When the pressure in the inflatable body (11) is lower than the low reference pressure during deflation, the moving shaft (7) moves downward. In either case, the moving shaft (7) pushes the limiting rod (8) away to disengage the limiting protrusion (82) on the limiting rod (8) with the second recess (51) of the valve shaft (5), and the valve shaft (5) is returned by the recovering device. The pump switch (2) is disconnected and the inflation-deflation valve (3) is closed, thereby stopping inflation or deflation.

The moving bladder (6) is mounted in a chamber. The chamber communicates with the inflatable body (11) through an inlet (61) of the moving bladder (6) so that the two sides of the moving bladder (6) are respectively exposed to the reference pressure and the pressure of the inflatable body (11). Through the inlet (61) of the moving bladder (6), the moving bladder (6) determines whether the pressure in the inflatable body (11) is higher than the high reference pressure or lower than the low reference pressure. When the pressure in the inflatable body (11) is higher than the high reference pressure during inflation, the moving bladder (6) expands to move the moving shaft (7) upwards. When the pressure in the inflatable body (11) is lower than the low reference pressure during deflation, the moving bladder (6) contracts to move the moving shaft (7) downwards.

The external force is acted by the valve bladder (4) via a manual bladder (9) connected to the valve bladder (4). When the manual bladder (9) is pressed by hand, the valve bladder (4) is moved downward by the pressure to open the inflation-deflation valve (3) and to drive the pump (1).

Embodiment 2

With reference to FIGS. 10 to 19, another embodiment of the inflation-deflation controlling mechanism and the pressure-controlling mechanism is disclosed.

The inflation-deflation controlling mechanism comprises a positioning panel (14), a lifting device that may move up and down for a certain distance and a first recovering device. The positioning panel (14) is connected to the inflation-deflation valve (3) through the lifting device and the first recovering device. Here, the positioning panel (14) is a knob, is rotatable and is connected to a selecting segment of the pump switch (2). When the positioning panel (14) is rotated, the selecting segment hits different switching segment to change the operating direction of the pump (1) and to determine whether the pump (1) inflates or deflates. In other embodiments, the positioning panel (14) may be a pushbutton.

When an external force acts on the positioning panel (14), the pump switch (2) is connected and the pressure-controlling mechanism blocks the positioning panel (14). The lifting device moves downward for a certain distance to open the inflation-deflation valve (3). When the pressure in the inflatable body is higher than the high reference pressure or lower than the low reference pressure, the pressure-controlling mechanism leaves the positioning panel (14). The positioning panel (14) is returned via the first recovering device and the lifting device. The pump switch (2) is disconnected and the lifting device is returned via the first recovering device. Then the lifting device closes the inflation-deflation valve (3) to finish inflating or deflating to the inflatable body (11).

The pressure-controlling mechanism comprises a moving bladder (6), a moving shaft (7), a first linking rod (15) and a second linking rod (16). One end of the moving shaft (7) is connected to the moving bladder (6), and the other end of the moving shaft (7) is connected to the first linking rod (15). The first linking rod (15) is pivoted along a fixed axis and is connected to the second linking rod (16). An end of the second linking rod (16) engages a recess formed in the positioning panel (14).

When the pressure in the inflatable body (11) is higher than the high reference pressure during inflation, the moving shaft (7) moves up. When the pressure in the inflatable body (11) is lower than the low reference pressure during deflation, the moving shaft (7) moves down. The first linking rod (15) moves the second linking rod (16) to disengage the second linking rod (16) from the positioning panel (14). The positioning panel (14) is returned to close the inflation-deflation valve (3) and the pump (1).

The lifting device comprises a lifting button (17) mounted under the positioning panel (14), a lifting rod (18) being coaxial with the positioning panel (14) and moving along the lifting curved surface in the lifting button (17), a linking rod (13) mounted under the lifting button (17), and a guiding recess (12) mounted around the lifting rod (18). The linking rod (13) is connected to the inflation-deflation valve (3) through the first recovering device.

The first recovering device comprises a supporting rod connecting to the linking rod (13) and the inflation-deflation valve (3) and a recovering spring (20) mounted around the supporting rod.

The moving bladder (6) is connected to an air opening (63) through a tube (62). The high reference pressure and the low reference pressure are determined by the compression medium in the moving bladder (6). Through the tube (62) and the air opening (63), the pressure-controlling mechanism determines whether the pressure in the inflatable body (11) is higher than the high reference pressure or lower than the low reference pressure.

The second linking rod (16) has multiple linking positioning recess (161) to engage the first linking rod (15).

The positioning panel (14) provides external force through a control switch (19) connecting to the positioning panel (14). The control switch (19) may be a knob or a pushbutton. When the knob is rotated, the positioning panel (14) is rotated by the knob to open the inflation-deflation valve (3) and to turn on the pump (1).

Embodiment 3

The third embodiment is similar to the second embodiment, but discloses another embodiment of the pressure-controlling mechanism, as shown in FIGS. 20 to 23.

The inflation-deflation controlling mechanism comprises a positioning panel (14), a lifting device that may move up and down for a certain distance and a first recovering device. The positioning panel (14) is connected to the inflation-deflation valve (3) through the lifting device and the first recovering device. Here, the positioning panel (14) is a knob and is rotatable. In other embodiments, the positioning panel (14) may be a pushbutton.

When an external force acts on the positioning panel (14), the pump switch (2) is connected and the pressure-controlling mechanism blocks the positioning panel (14). The lifting device moves downward for a certain distance to open the inflation-deflation valve (3). When the pressure in the inflatable body is higher than the high reference pressure or lower than the low reference pressure, the pressure-controlling mechanism leaves the positioning panel (14). The lifting device is returned via the first recovering device.

The pressure-controlling mechanism comprises a moving bladder (6), a moving shaft (7), a detecting switch (21), an electromagnet (22) and a third linking rod (23). One end of the moving shaft (7) is connected to the moving bladder (6) and the other end contacts with the detecting switch (21) via the operating of the moving bladder (6). The electromagnet (22) is connected electrically to the detecting switch (21) and one end of the third linking rod (23). The other end of the third linking rod (23) selectively engages the recess of the positioning panel (14). The detecting switch (21) has an upper segment, a lower segment and a selecting segment between them. When the moving shaft (7) moves via the operating of the moving bladder (6), an actuating segment of the moving shaft (7) selectively drives the upper or lower segments to "control operation of the electromagnet (22)".

When the pressure in the inflatable body (11) is higher than the high reference pressure during inflation, the moving shaft (7) moves up to contact with the detecting switch (21). When the pressure in the inflatable body (11) is lower than the low reference pressure during deflation, the moving shaft (7) moves down to contact with the detecting switch (21). With the detecting switch (21) sending signal to move the electromagnet (22) up and down, the third linking rod (23) is moved up and down to disengage the third linking rod (23) from the positioning panel (14). The positioning panel (14) is returned to close the inflation-deflation valve (3) and the pump (1).

The third linking rod (23) has multiple linking positioning recesses (231).

The electromagnet (22) is a push-pull electromagnet and may be moved axially by the signal.

Embodiment 4

Figure 24:
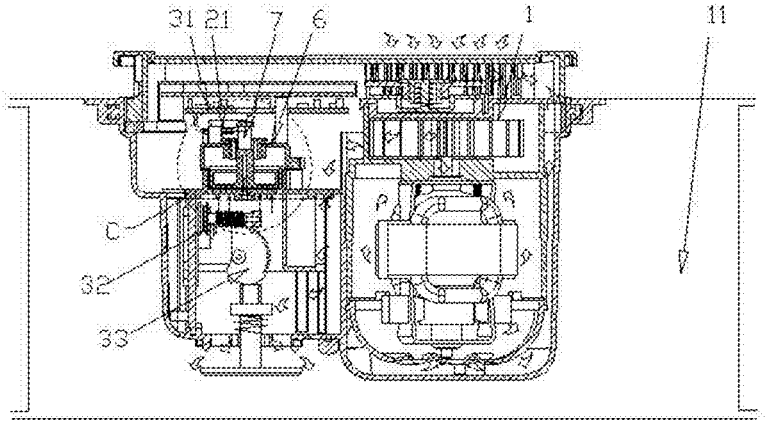
FIG. 24 is a front view in partial section of a fourth embodiment of a pressure-controlling appliance in accordance with the present invention.
Figure 25:
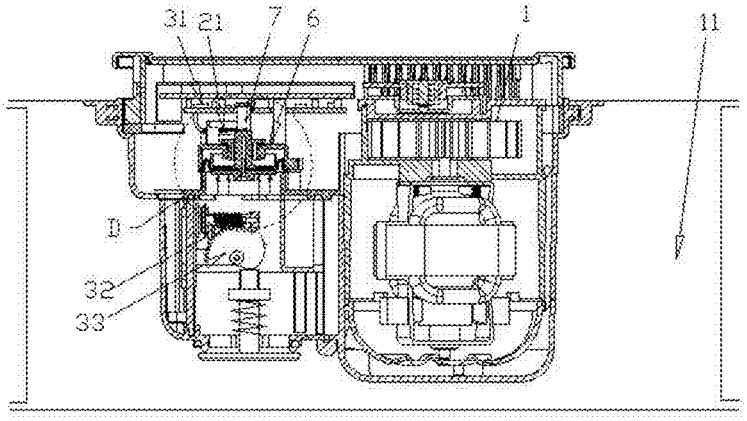
FIG. 25 is an operational front view in partial section of a pressure-controlling appliance in FIG. 24, showing inflating to a predetermined pressure.
Figure 26A:
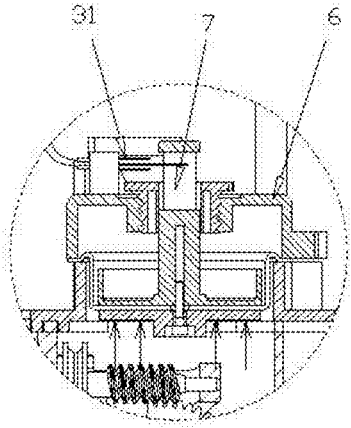
FIG. 26A is an enlarged front view of a pressure-controlling appliance, showing section C in FIG. 24.
Figure 26B:
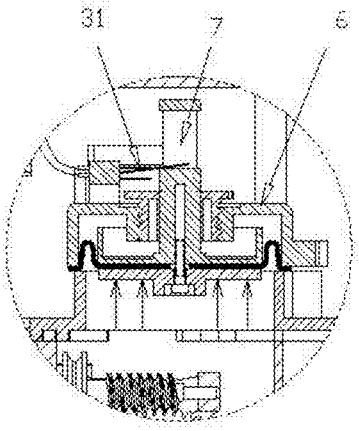
FIG. 26B is an enlarged front view of a pressure-controlling appliance, showing section D in FIG. 25.

FIGS. 24 to 26 show another embodiment of the inflation-deflation controlling mechanism and the pressure-controlling mechanism.

The inflating-deflating mechanism comprises a control circuit (31), a driving device, a second lifting device and a third recovering device. The control circuit (31) generates controlling commands to switch on or off the pump switch. The control circuit (31) drives the second lifting device up and down through the driving device. The second lifting device is connected to the inflation-deflation valve (3) through the third recovering device.

When a command is input into the control circuit (31), the pump switch is connected and the lifting device descends a certain distance. Then the inflation-deflation valve (3) is opened and the pump (1) is operated. When the pressure in the inflatable body (11) is higher than the high reference pressure or lower than the low reference pressure, the pressure-controlling mechanism outputs a signal to the control circuit (31). The control circuit (31) disconnects the pump switch (2). The second lifting device is returned and the inflation-deflation valve (3) is returned via the third recovering device. The third recovering device also comprises a supporting rod connecting to the inflation-deflation valve (3) and a recovering spring mounted around the supporting rod.

The second lifting device comprises a worm rod (32) connecting to the driving device and a worm gear (33) engaging the worm rod (32). The worm gear (33) abuts the third recovering device. The worm gear (33) has a long axis and a short axis. When the inflation-deflation valve (3) is closed, the long axis is along lateral axis and the short axis is along upright axis. When the lifting device receives an opening signal, the worm rod (32) engages the worm gear (33) to rotate the long axis of the worm gear (33) gradually to the upright axis. The third recovering device is moved downward by the pressing of the worm gear (33) to open the inflation-deflation valve (3). When the lifting device receive an closing signal, the operation is reversed. The driving device may be a step motor.

The pressure-controlling mechanism comprises a moving bladder (6), a moving shaft (7) and a second detecting switch (21). One end of the moving shaft (7) is connected to the moving bladder (6) and the other end selectively contacts with the second detecting switch (21) via the operation of the moving bladder (6).

When the pressure in the inflatable body (11) is higher than the high reference pressure, the moving shaft (7) moves up to contact with the second detecting switch (21) to send signal to the control circuit (31). When the pressure in the inflatable body (11) is lower than the low reference pressure, the moving shaft (7) moves down to contact with the second detecting switch (21) to send signal to the control circuit (31).

Embodiment 5

The fifth embodiment is similar to the first embodiment and provides a pressure-controlling appliance comprises a inflatable body, a pump mounted in the inflatable body, a pump switch and an inflation-deflation valve. The pump inflates or deflates the inflatable bodythrough the inflation-deflation valve. The pressure-controlling appliance also comprises an inflation-deflation controlling mechanism and a pressure-controlling mechanism. The inflation-deflation controlling mechanism is applied to open or close the inflation-deflation valve and to turn the pump switch on. The pressure-controlling mechanism operates the inflation-deflation controlling mechanism and the pump switch based on the pressure in the inflatable body that compared with the high or low reference pressure.

The difference between the fifth embodiment and the first embodiment is that the pump switch is turned off by the pressure controlling mechanism. Specifically, the pressure-controlling mechanism is a movable assembly that may move and return based on the pressure in the inflatable body and the reference pressure and also control inflation-deflation controlling mechanism to close the inflation-deflation valve (3). When the movable assembly moves to selectively contact with the pump switch (2), the pump switch (2) is connected or disconnected. The pump switch (2) is connected to and drives the pump (1).

What is claimed is:

1. A pressure-controlling appliance of an inflatable product, comprising:

an inflatable body a pump mounted in the inflatable body;

an inflation-deflation valve, wherein the pump is arranged to inflate and deflate the inflatable body through the inflation-deflation valve;

an inflation-deflation controlling mechanism arranged to open and non-electromechanically close the inflation-deflation valve; and a pressure-controlling mechanism operating the inflation-deflation controlling mechanism based on the pressure in the inflatable body compared with a high or low reference pressure, the pressure-controlling mechanism comprising a moving bladder and a moving shaft configured such that when the pressure in the inflatable body is higher than the high reference pressure during inflation, the moving shaft moves in a first direction to operate the inflation-deflation controlling mechanism to close the inflation-deflation valve and to turn the pump off, and when the pressure in the inflatable body is lower than the low reference pressure during deflation, the moving shaft moves in a second direction to operate the inflation-deflation controlling mechanism to turn the pump off wherein the moving shaft is connected mechanically to the moving bladder and the inflation-deflation controlling mechanism.

2. The pressure-controlling appliance of claim 1, further comprising a pump switch operable to turn the pump on and off.

3. The pressure-controlling appliance of claim 2, wherein the inflation-deflation controlling mechanism comprises a valve bladder, and a valve shaft and a recovering device, wherein one end of the valve shaft is connected to the valve bladder and the other end of the valve shaft is connected to the inflation-deflation valve through the recovering device, and the valve shaft has a protrusion selectively contacting the pump switch, arranged such that when an external force acts on the valve bladder, the valve shaft moves downward and opens the inflation deflation valve, and the protrusion on the valve shaft causes the pump switch to turn the pump on.

4. The pressure-controlling appliance of claim 3, wherein the pressure-controlling mechanism is arranged to by default block the valve shaft and keep the inflation-deflation valve open when the inflation valve is opened by the inflation-deflation controlling mechanism.

5. The pressure-controlling appliance of claim 4, wherein the pressure-controlling mechanism is arranged such that when the pressure in the inflatable body is higher than the high reference pressure during inflation or lower than the low reference pressure during deflation, the pressure-controlling mechanism disengages from the valve shaft and the valve shaft is returned by the recovering device, thereby closing the inflation-deflation valve.

6. The pressure-controlling appliance of claim 5, wherein the pressure-controlling mechanism further comprises a limiting rod, wherein movement of the moving shaft in the first and second directions causes the limiting rod to disengage from the valve shaft, allowing valve shaft to be returned by the recovering device.

7. The pressure-controlling appliance of claim 6, wherein one end of the moving shaft is connected to the moving bladder, a first recess is formed in another end of the moving shaft and corresponds to a roller on one end of the limiting rod, the limiting rod has a limiting protrusion corresponding to and selectively engaging a second recess in the valve shaft, the other end of the limiting rod is fastened to a fixed axis, and the first recess on the moving shaft selectively moves up and down relative to the roller on the limiting rod.

8. The pressure-controlling appliance of claim 6, wherein the moving bladder is mounted in a chamber, the chamber communicating with the inflatable body through an inlet of the moving bladder.

9. The pressure-controlling appliance of claim 6, wherein the moving bladder is connected to an air opening through a tube.

10. The pressure-controlling appliance of claim 3, further comprising a manual bladder connected to the valve bladder and exerting the external force thereon.

11. A pressure-controlling appliance of an inflatable product, comprising:

an inflatable body a pump mounted in the inflatable body;

an inflation-deflation valve, wherein the pump is arranged to inflate and deflate the inflatable body through the inflation-deflation valve;

an inflation-deflation controlling mechanism arranged to open and close the inflation-deflation valve and to turn the pump on and off;

a pressure-controlling mechanism operating the inflation-deflation controlling mechanism based on the pressure in the inflatable body compared with a high or low reference pressure, arranged such that when the pressure in the inflatable body is higher than the high reference pressure during inflation, the pressure-controlling mechanism operates the inflation-deflation controlling mechanism to close the inflation-deflation valve and to turn the pump off, and when the pressure in the inflatable body is lower than the low reference pressure during deflation, the pressure-controlling mechanism operates the inflation-deflation controlling mechanism to close the inflation-deflation valve and to turn the pump off; and a pump switch operable to turn the pump on and off;

wherein the inflation-deflation controlling mechanism comprises a positioning panel, a lifting device movable up and down by a certain distance, and a recovering device, wherein the positioning panel is connected to the inflation-deflation valve through the lifting device and the recovering device, arranged such that when an external force acts on the positioning panel, the pump switch is connected and the pressure-controlling mechanism blocks the positioning panel, and the lifting device moves downward a certain distance and the inflation-deflation valve is opened.

12. The pressure-controlling appliance of claim 11, wherein the pressure-controlling mechanism comprises a moving bladder, a moving shaft, a first linking rod and a second linking rod, wherein when the pressure in the inflatable body is higher than the high reference pressure during inflation or lower than the low reference pressure during deflation, the moving shaft moves up or down and the first linking rod moves the second linking rod to disengage the second linking rod from the positioning panel, thereby closing the inflation-deflation valve.

13. The pressure-controlling appliance of claim 12, wherein one end of the moving shaft is connected to the moving bladder and the other end of the moving shaft is connected to the first linking rod, the first linking rod is pivoted along a fixed axis and is connected to the second linking rod, and an end of the second linking rod engages a recess formed in the positioning panel.

14. The pressure-controlling appliance of claim 12, wherein the lifting device comprises a lifting button mounted under the positioning panel, a lifting rod being coaxial with the positioning panel and moving along a lifting curved surface in the lifting button, and a third linking rod mounted under the lifting button, wherein the third linking rod is connected to the inflation-deflation valve through the recovering device.

15. The pressure-controlling appliance of claim 11, further comprising a control switch connected to the positioning panel and providing the external force there through.

16. The pressure-controlling appliance of claim 11, wherein the pressure-controlling mechanism comprises a moving bladder, a moving shaft, a detecting switch, an electromagnet and a linking rod, wherein one end of the moving shaft is connected to the moving bladder and another end contacts with the detecting switch via the operating of the moving bladder, the electromagnet is connected electrically to the detecting switch and one end of the linking rod, and the other end of the linking rod selectively engages the recess of the positioning panel, arranged such that when the pressure in the inflatable body is higher than the high reference pressure during inflation, the moving shaft moves up to contact with the detecting switch, when the pressure in the inflatable body is lower than the low reference pressure during deflation, the moving shaft moves down to contact with the detecting switch, and when contacted, the detecting switch sends a signal to move the electromagnet up or down, the linking rod is moved up or down to disengage the linking rod from the positioning panel, thereby closing the inflation-deflation valve.

17. The pressure-controlling appliance of claim 16, wherein the electromagnet is a push-pull electromagnet.

18. The pressure-controlling appliance of claim 2, wherein the inflating-deflating mechanism comprises a control circuit, wherein the control circuit is operable to generate controlling commands to switch on and off the pump switch, arranged such that when the pressure in the inflatable body is higher than the high reference pressure during inflation or lower than the low reference pressure during deflation, the pressure-controlling mechanism outputs a signal to the control circuit and the control circuit disconnects the pump switch and the inflation-deflation valve is closed.

19. The pressure-controlling appliance of claim 18, wherein the inflating-deflating mechanism comprises a driving device, a lifting device and a recovering device, wherein the control circuit is operable to drive the lifting device up and down through the driving device, and the lifting device is connected to the inflation-deflation valve through the recovering device, arranged such that when a command is input into the control circuit, the pump switch is connected and the lifting device descends a certain distance wherein, and when the pressure in the inflatable body is higher than the high reference pressure during inflation or lower than the low reference pressure during deflation, the pressure-controlling mechanism outputs a signal to the control circuit and the control circuit disconnects the pump switch, and the lifting device is returned and the inflation-deflation valve is closed.

20. The pressure-controlling appliance of claim 19, wherein the lifting device comprises a worm rod connecting to the driving device and a worm gear engaging the worm rod, wherein the worm gear abuts the recovering device.

21. The pressure-controlling appliance of claim 19, wherein the pressure-controlling mechanism further comprises a second detecting switch, wherein one end of the moving shaft is connected to the moving bladder and the other end selectively contacts the second detecting switch via the operation of the moving bladder, arranged such that when the pressure in the inflatable body is higher than the high reference pressure during inflation, the moving shaft moves in the first direction to contact with the second detecting switch to send a signal to the control circuit, and when the pressure in the inflatable body is lower than the low reference pressure during deflation, the moving shaft moves in the second direction to contact with the second detecting switch to send a signal to the control circuit.

22. A pressure-controlling appliance comprising:

an inflatable body;

a pump mounted in the inflatable body;

a pump switch;

an inflation-deflation valve, wherein the pump inflates and deflates the inflatable body through the inflation-deflation valve;

an inflation-deflation controlling mechanism comprising a recovering device, wherein the inflation-deflation controlling mechanism is arranged to non-electromechanically open and close the inflation-deflation valve and to turn the pump switch on, wherein the recovering device is biased to non-electromechanically close the inflation-deflation valve; and a pressure-controlling mechanism arranged to non-electromechanically operate the inflation-deflation controlling mechanism and turn the pump switch off based on the pressure in the inflatable body that compared with a high or low reference pressure, the pressure-controlling mechanism comprising a moving bladder and a moving shaft configured such that when the pressure in the inflatable body is higher than the high reference pressure during inflation, the moving shaft moves in a first direction to operate the inflation-deflation controlling mechanism to close the inflation-deflation valve and to turn the pump off, and when the pressure in the inflatable body is lower than the low reference pressure during deflation, that the moving shaft moves in a second direction to operate the inflation-deflation controlling mechanism to turn the pump off wherein the moving shaft is connected mechanically to the moving bladder and the inflation-deflation controlling mechanism.

23. The pressure-controlling appliance of claim 12, wherein the second linking rod has multiple linking positioning recesses to selectively engage the protrusion of the first linking rod.

24. The pressure-controlling appliance of claim 1, arranged such that when the pressure in the inflatable body is lower than the low reference pressure during deflation, the pressure-controlling mechanism operates the inflation-deflation controlling mechanism to close the inflation-deflation valve.

25. The pressure-controlling appliance of claim 1, wherein the inflation-deflation controlling mechanism comprises a recovering device comprising a spring biased to close the inflation-deflation valve.

26. The pressure-controlling appliance of claim 22, wherein the recovering device comprises a spring.

27. A pressure-controlling appliance comprising:

an inflatable body;

a pump mounted in the inflatable body;

a pump switch;

an inflation valve, wherein the pump inflates and deflates the inflatable body through the inflation valve;

an inflation controlling mechanism comprising a recovering device, wherein the inflation controlling mechanism is arranged to non-electromechanically open and close the inflation valve and to turn the pump switch on, wherein the recovering device is biased to non-electromechanically close the inflation valve; and a pressure-controlling mechanism arranged to non-electromechanically operate the inflation controlling mechanism and turns the pump switch off based on the pressure in the inflatable body that compared with a predetermined reference pressure, the pressure-controlling mechanism comprising a moving bladder and a moving shaft configured such that when the pressure in the inflatable body is higher than a high reference pressure during inflation, the moving shaft moves in a first direction to operate the inflation controlling mechanism to close the inflation valve and to turn the pump off wherein the moving shaft is connected mechanically to the moving bladder and the inflation controlling mechanism.

* * * * *